US006438876B2

(12) United States Patent
Har et al.

(10) Patent No.: US 6,438,876 B2
(45) Date of Patent: Aug. 27, 2002

(54) STEAM IRON

(75) Inventors: Tang Pong Har; Sundaram S. Arun, both of Singapore (SG)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/761,245

(22) Filed: Jan. 16, 2001

(30) Foreign Application Priority Data

Jan. 25, 2000 (SG) ..... 200000430-9

(51) Int. Cl.[7] ..... D06F 75/26
(52) U.S. Cl. ..... 38/77.7
(58) Field of Search ..... 38/77.7, 77.83, 38/93; 219/248, 254, 255

(56) References Cited

U.S. PATENT DOCUMENTS 5,042,179 A * 8/1991 Van der Meer ..... 38/77.83
5,642,578 A * 7/1997 Hazan et al. ..... 38/77.7
5,642,579 A 7/1997 Netten et al.
6,079,133 A * 6/2000 Netten ..... 38/77.7

FOREIGN PATENT DOCUMENTS

EP 0390264 A1 3/1990
JP 139300 * 8/1984 ..... 38/77.7
JP 2016799 * 1/1987 ..... 38/77.7

* cited by examiner

*Primary Examiner*—Ismael Izaguirre
(74) *Attorney, Agent, or Firm*—John Vodopia

(57) ABSTRACT

An electric steam iron includes an electrically heated soleplate (2). The soleplate (2) has at least one steam vent (20). The iron also includes a controllable steam generator (6) for supplying steam to the steam vent (20). The iron further includes a controller (16) for controlling the steam generator (6) and a temperature sensor (24) for sensing the tempature of the soleplate (2). The temperature sensor (24) supplies a temperature dependent signal to the controller (16). The controller (16) is adapted to activate the steam generator (6) in accordance with a predetermined steam pattern. The steam pattern includes at least a first phase of a first predetermined duration, in which steam is supplied a substantially constant peak steam rate, and at least a second phase, in which team is supplied at a substantially constant lower steam rate. At least the peak steam rate depends upon the temperature of the soleplate (2).

12 Claims, 2 Drawing Sheets

STEAM IRON

Figure 1:
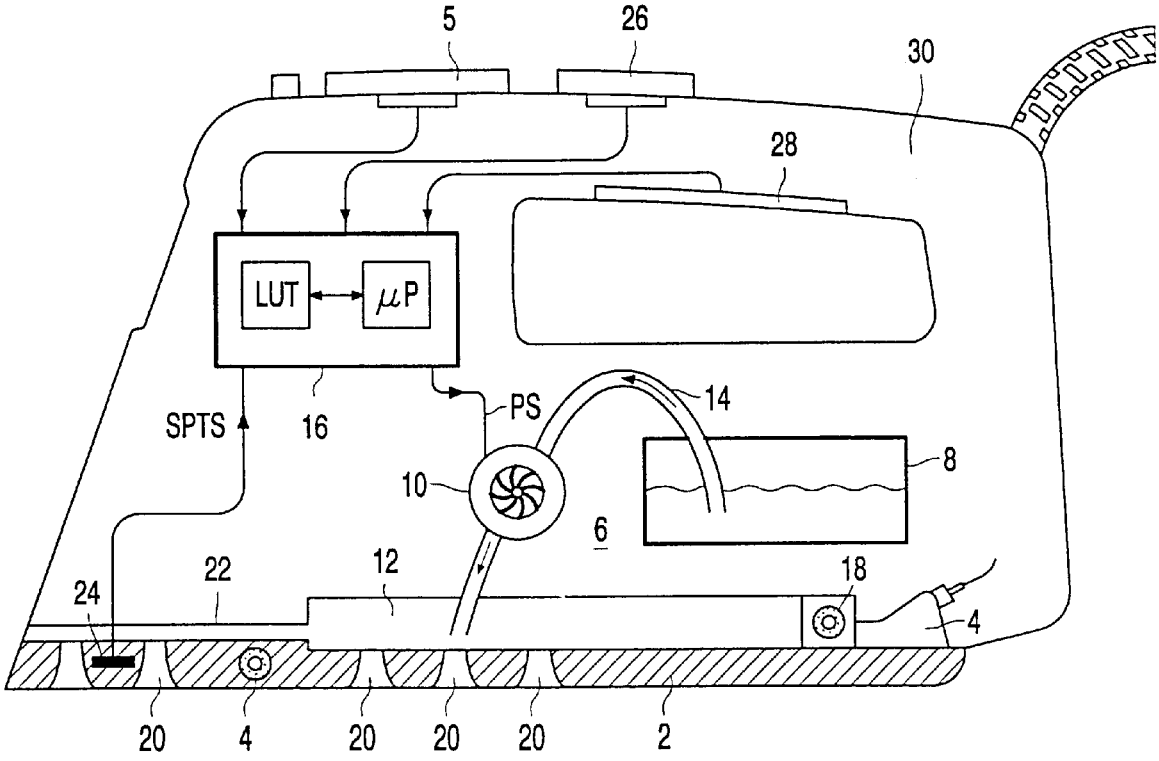

The invention relates to an electric steam iron comprising an electrically heated soleplate, said soleplate having at least one steam vent, a controllable steam generator for supplying steam to the at least one steam vent, and control means for controlling the steam generator.

An electric steam iron of the above type has been disclosed in European patent application No. 0 390 264.

In ironing of clothing three different processes can be distinguished: conditioning of the fibers, relaxation of the fibers and fixation of the fibers. During the conditioning the fibers are prepared for the relaxation. The conditioning is done by increasing the temperature of the fibers in order to make the fibers weak, which during the relaxation, enhance the recovery of the fibers from the plastic deformation caused by wearing of the clothing. The use of steam is an effective way to increase the temperature. Moreover, the weakness of some fibers also increases with the water content, especially for cotton, linen, viscose and wool. After the conditioning the relaxation or real ironing takes place. During the relaxation the weak fibers are being pressed between the soleplate and the ironing board. This should last sufficiently long to allow the fibers to recover from the plastic deformation. The moisture content of the fabric should not decrease too fast during relaxation in the case of cotton, linen and wool, as this would adversely affect the relaxation process. After relaxation the opposite from the conditioning takes place. This means that the weakness of the fibers is reduced to prevent the return of wrinkles. The fixation comprises the drying of the fibers, followed by cooling down.

During the conditioning the temperature of the fabric increases to about 100° C., partly by condensation of steam and partly due to heating by the soleplate. During the relaxation the temperature should be kept at about 100° C. to maintain both a high temperature and a high moisture content of the fabric, which provides for a fast recovery of the fibers. After the relaxation the fabric is being dried, indicated by a temperature increase in the fabric above 100° C., and followed by cooling down to assure a proper fixation. This cooling down takes place partly on the ironing board and partly after removal of the cloth from the board to clear the board for the next cloth.

In conventional steam irons the steam rate is set and the iron is moved forwards and backwards over the fabric. In the forward stroke the amount of steam is insufficient in most cases to heat the fabric up to 100° C., whereas after passing of the steam vents the fabric is heated further by the soleplate to a higher temperature closer to 100° C. In the backward stroke the production of steam still continues, but the fabric will already reach 100° C. and will not adsorb much water. Although it does not affect the fabric, steam is wasted that could have been used to warm up and more intensively moisten the fabric in order to obtain a weaker fabric at a higher temperature during the forward stroke. Unused steam is blown through the fabric into the ironing board and to the surrounding air without the desired condensation onto and in the fabric. Thus, a lot of heat and water is wasted.

In the steam iron disclosed in the above mentioned European patent application No. 0 390 264 waste of steam is reduced by controlling the amount of steam produced by the steam generator as a function of time. The steam generator includes a steam chamber which is designed as a pressure tank and in which a buffer stock of steam is formed, which is released at the beginning of an ironing cycle. The amount of steam produced starts with a high value and decreases more or less from that value linearly to a lower value. The steam production is controlled by regulating the output power of an additional heating element specifically provided for the steam buffer chamber. It is further known to adapt the steam production in said known steam iron to the amount of heat required to heat the fabric, by measuring the power need of the heating element of the soleplate. Such measuring, however, is inaccurate and slow.

An electric steam iron having an improved steam generation as compared to the iron disclosed in EP-A-0 390 264 is disclosed in U.S. Pat. No. 5,642,579. In accordance with U.S. Pat. No. 5,642,579 a steam iron comprises a fabric temperature sensor for detecting the temperature of the fabric to be ironed and control means responsive to a signal from the fabric temperature sensor for controlling the amount of steam produced. Thus steam generation is controlled by the fabric temperature and this is done in such a manner that steaming is stopped when a predetermined fabric temperature of about 100° C. or a slightly lower temperature is reached. A cool fabric automatically triggers the steam production and the steam production is automatically shut off when the fabric has reached the predetermined fabric temperature.

In accordance with the present invention the steam production does not depend upon a buffer stock in a heated pressure tank. Moreover, the steam production is not based on the temperature of the fabric being ironed but on the soleplate temperature. More in particular, in accordance with the present invention each soleplate temperature value or range of values corresponds to a specific steam generation pattern comprising a substantially constant peak steam rate during a first time interval and a substantially constant lower peak steam rate during a second time interval.

The invention provides an improved electric steam iron comprising an electrically heated soleplate, said soleplate having at least one steam vent; a controllable steam generator for supplying steam to the at least one steam vent and control means for controlling the steam generator, wherein the steam iron further comprises temperature sensor means for sensing the temperature of the soleplate, said temperature sensor means in use supplying a temperature dependent signal to the control means, and wherein the control means is arranged to activate the steam generator in accordance with a predetermined steam pattern comprising at least a first phase of a first predetermined duration, in which steam is supplied at a substantially constant peak steam rate, and at least a second phase, in which steam is supplied at a substantially constant lower steam rate, wherein at least said peak steam rate depends upon the soleplate temperature.

The invention will now be explained in greater detail with reference to the drawing.

Figure 2:
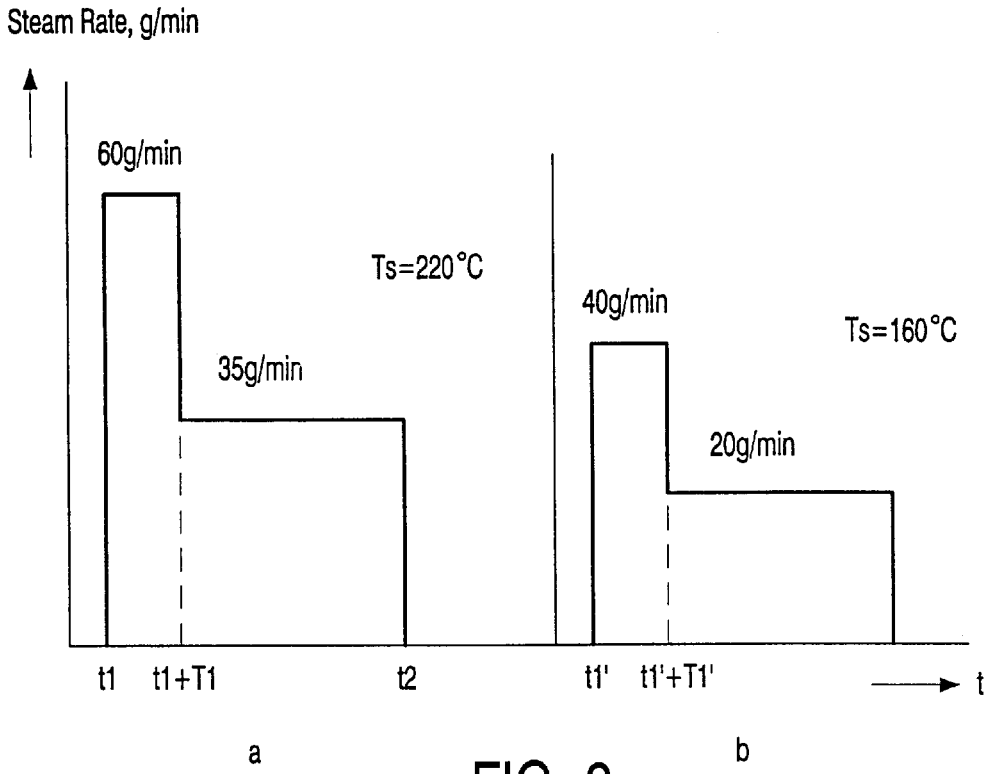
Figure 3:
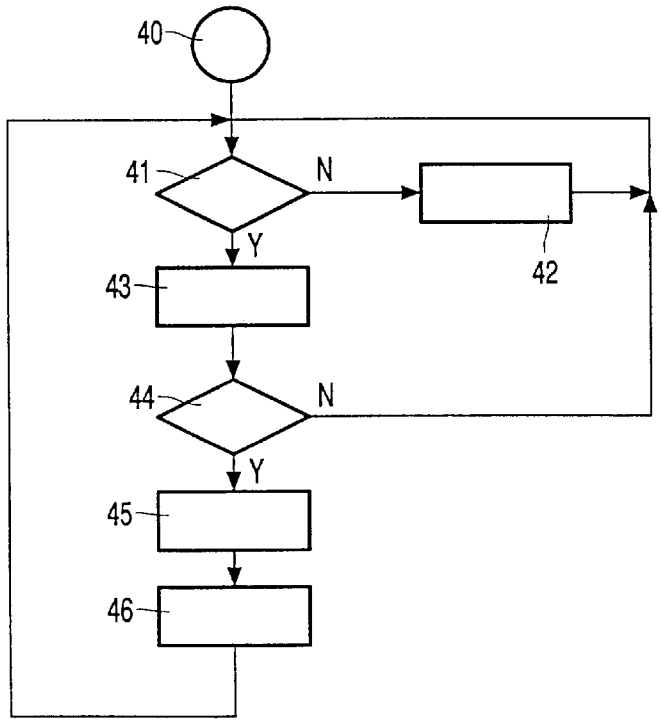

FIG. 1 schematically shows an example of an electric steam iron in accordance with the invention;

FIG. 2 graphically shows by way of example two steam/time patterns for use in an electric steam iron in accordance with the present invention; and FIG. 3 shows a flow chart of an example of a control program for an electric steam iron according to the invention.

FIG. 1 shows an example of a steam iron embodying the invention, having soleplate temperature dependent steam generation. The steam iron has a conventional soleplate 2, which is heated by an electric heating element 4. The temperature of the soleplate 2 is kept at a desired temperature by means of a conventional thermostat (not shown) and a temperature dial 5 as known from the art of conventional steam irons. However, alternatively other known means to control the temperature of the soleplate 2 can be employed, such as fully electronic control with a triac, a temperature sensor for measuring the temperature of the soleplate and an adjustable reference for changing the desired temperature of the soleplate. Steam is generated by a steam generator 6, which comprises a water tank 8, a water dosing means, in this example a pump 10, and a steam chamber 12. The water pump 10 pumps water from the water tank 8 to the steam chamber 12 via a hose 14 under command of a pump signal PS from an electric control device 16. The steam chamber 12 is heated by the soleplate, but an auxiliary heating element may be provided. FIG. 1 by way of example shows an auxiliary heating element 18, which may be controlled by a conventional thermostat (not shown), or an electronic or a similar control device. The steam from the steam chamber 12 reaches steam vents 20 connected to the steam chamber or to a steam duct 22. A soleplate temperature sensor 24 is embedded in the soleplate 2 at a suitable location and in this embodiment it is surrounded by the steam vents 20. The temperature sensor 24 may be the same sensor as used in some irons for monitoring the soleplate temperature in order to control the soleplate temperature, or it may be a separate temperature sensor. The temperature sensor 24 senses the soleplate temperature during ironing and sends a soleplate temperature signal SPTS to the control device 16, which signal is indicative of the actual temperature of the soleplate. The temperature sensor 24 may be a resistor with a positive temperature coefficient (PTC) or a negative temperature coefficient (NTC) of suitable dimensions. A thermocouple or a contactless infra-red sensor may be used as well.

All electrical parts, such as the heating element 4, the heating element 18 (if present), the water pump 10 and the control device 16 receive suitable AC or DC supply voltages in a conventional manner, not shown.

The steam iron shown in FIG. 1 further has a selector switch or button 26 by means of which the user may select dry ironing or activate steam ironing. The present embodiment has also a handsensor 28 in or on the handle 30 of the iron. The hand sensor may be for example a switch device, or a photocell, a touch control device or a leakage current switch. A suitable hand sensor would be a capacitive sensor. However, a movement detector located anywhere in the iron may also be used as a hand sensor.

The selector switch 26 and the hand sensor 28 both supply signals to the control device 16. Said signals may be received, for example, by an AND-device (not shown), whose output signal is an enabling signal for the control device, without which signal no pump signal activating PS will be supplied. In a preferred embodiment the predetermined steam pattern will selectively either be started automatically at the beginning of a new ironing cycle after a preceding ironing cycle has been terminated by placing the iron on its heel, or it will be started after the user has operated a control button or the like. For the selection of automatic (smart steam) operation or user initiated operation a suitable selector means may be provided. Said selector means could be combined with the selector switch mentioned above or it could be a separate means.

The control device may comprise a microcomputer suitably programmed with control software, or it may be a dedicated electronic circuit.

A flow chart representing an example of a program for a programmable control device is shown in FIG. 3. The elements of the flow chart have the following inscriptions:

40 START
41 T>Tmin?
42 DEACTIVATE PUMP
43 RECORD SOLEPLATE TEMPERATURE
44 USER'S HAND PRESENT?
45 RETRIEVE SUITABLE STEAM PATTERN FROM LUT
46 ACTIVATE PUMP
N means NO (false) and Y means YES (true)

The control device starts at step 40 in FIG. 3 after having received the necessary enabling signal(s) as indicated above.

In use the control device receives a soleplate temperature signal SPTS and first compares this signal with a predetermined value corresponding to a predetermined minimum temperature Tmin of, for example, 110° C. This is represented by step 41 in FIG. 3.

If the soleplate temperature is lower than the predetermined temperature a deactivation signal is sent to the pump, as shown in step 42. If the soleplate temperature is higher than the predetermined temperature the actual temperature value is determined and stored in step 43. In step 44 it is checked whether the user's hand is present. If not, the program returns to step 41. If the hand sensor is activated by the user's hand a suitable steam pattern is retrieved in step 45 from a look up table (LUT) stored in a memory of the microcomputer. As an alternative, the LUT may be incorporated in a chip. In a dedicated hardware circuit such a look up table may be represented, for example, by a number of comparators or a number of binary values which are compared with a binary value representing the actual soleplate temperature or a certain range including the actual soleplate temperature.

After having found a suitable steam pattern a corresponding pump signal is generated and the pump is activated correspondingly in step 46.

In accordance with the present invention a suitable steam pattern comprises a first phase of a predetermined duration during which steam is generated at a substantially constant peak steam rate. The first phase is immediately followed by a second phase during which steam is generated at a substantially constant but lower steam rate.

An example of a look-up table is shown below.

| Soleplate Temp (° C.) | Peak Steam (g/min) | Average Steam (g/min) |
|---|---|---|
| 190–230 | 60 | 35 |
| 160–190 | 45 | 25 |
| 130–160 | 30 | 15 |
| 110–130 | 15 | 5–10 |

FIG. 2 schematically shows two examples of steam patterns in accordance with the present invention. In the left-hand part of the graph of FIG. 2 the soleplate temperature is 220° C.

This results in a steam pattern comprising a peak steam production of 60 g/min for T1 seconds. T1 may be, for example, 6 seconds. Thereafter the steam production is reduced to a much lower value of 35g/min during a second time interval which may or may not have a predetermined duration.

The right-hand part of FIG. 2 relates to a soleplate temperature of 160° C., which results in a peak steam production of 40g/min during T1' seconds and then a reduced steam production of 20g/min.

The initial peak steam production phase during every new ironing cycle serves to wet the fabric with a large amount of moisture (condensed steam) before the fabric heats up to >100° C. and the moisture absorption decreases.

The initial peak steam production is much higher than the average steam production as can be sustained by the heating of the soleplate through the electric power absorbed by the iron. Such an initial high peak steam production is possible even though the soleplate temperature will decrease to a certain extent during steaming because of the thermal capacity of the soleplate, which thermal capacity allows the storage of heat in the soleplate between ironing cycles. Thus the maximum value of the peak steam production as well as the maximum value of T1 depend upon the thermal capacity of the soleplate. Thus, if the thermal capacity of the soleplate would allow a maximum steam peak rate of 60 g/min for 6 seconds it would also be possible to select a steam peak rate of, for example, 80 g/min for 4½ seconds or 120 g/min for 3 seconds. In general, the maximum steam peak rate SPRmax multiplied by T1max will provide a maximum value, which cannot be exceeded. Of course, lower values would be possible. Instead of 60 g/min for 6 seconds, one could choose to steam 40 g/min for 6 seconds or 120 g/min for 2 seconds etc. Thus, a plurality of LUT's, or a LUT having a plurality of sections to be chosen by the user, might be used.

The steam peak is follwed bythe second phase in which a lower steam rate prevails. The lower steam rate may be the average steam rate corresponding to the electrical energy used for heating the soleplate and the withdrawal of heat from the soleplate by the fabric and by the steam generation. Said average value could be maintained as long as desired, but a lower steam rate would also be possible. In order to obtain the desired amounts of steam the pump can be controlled by a suitable electric pump signal, for example a pulse signal, in order to pump the required amount of water from the water tank 8 to the steam chamber 12.

In a preferred embodiment the initial peak steam rate is the maximum peak steam rate allowed by the soleplate temperature, the thermal capacity of the soleplate and the peak steam time T1, whereas the lower steam rate in the second phase is also as high as possible and will be maintained as long as the ironing cycle lasts.

In the example of a look up table given above, the peak steam rate decreases as the soleplate temperature decreases, while the time interval during which the peak steam rate is generated is kept constant. As may have become clear from the above explanation, it would be possible to select a higher peak steam rate for a given soleplate temperature range if a shorter time interval is used. Thus, it would be possible to generate 60g/min of steam at a soleplate temperature in the range 160 –190° C. if T1 is not 6 seconds but 4.5 seconds.

The steam rate during the second phase should be equal to or lower than the maximum possible average steam rate. It would be possible to use less steps than the four steps indicated in the look-up table provided as an example. It would even be possible to use only a single average steam rate, which then should be such that it can be sustained even at the lowest soleplate temperature range.

However, as stated before, the maximum amount of steam will be desired in general.

It is to be noted that after the above explanation of the invention various modifications will be obvious to a person skilled in the art. For example, a look-up table having more than one section may be used, wherein the section to be used depends upon the type of fabric to be ironed, for example thick, medium or thin fabrics. Settings operable by the user to this effect may be available on the iron. As an alternative, the duration of the first and possibly second phase might be varied depending upon the type of fabric.

Further, instead of an electronic control means an at least partly mechanical control means including at least one bimetal element could be used.

What is claimed is:

1. An electric steam iron comprising an electrically heated soleplate (2), said soleplate (2) having at least one steam vent (20); a controllable steam generator (6) for supplying steam to the at least one steam vent (20), and control means (16) for controlling the steam generator (6), wherein the steam iron further comprises a temperature sensor means (24) for sensing the temperature of the soleplate (2), said temperature sensor means (24) in operation supplying a temperature dependent signal to the control means (16), and wherein the control means (16) is adapted to activate the steam generator (6) in accordance with a predetermined steam pattern comprising at least a first phase of a first predetermined duration, in which steam is supplied at a substantially constant peak steam rate, and at least a second phase, in which steam is supplied at a substantially constant lower steam rate, wherein at least said peak steam rate depends upon the temperature of the soleplate (2).

2. An electric steam iron as claimed in claim 1, wherein the lower steam rate depends upon the temperature of the soleplate (2).

3. An electric steam iron as claimed in claim 2, wherein the lower steam rate is substantially equal to the steam rate that can be sustained by the electric power available for heating the soleplate (2).

4. An electric steam iron as claimed in claim 1, 2 or 3, wherein the control means (16) include a programmable microcomputer using a look-up table in order to select a steam pattern depending upon the temperature dependent signal from the temperature sensor (24).

5. An electric steam iron as claimed in claim 1, comprising a steam on/off switch (26) which in operation supplies an input signal to the control means.

6. An electric steam iron as claimed in claim 1, comprising a hand-presence sensor (28) for supplying an input signal to the control means (16).

7. An electric steam iron as claimed in claim 1, comprising a setting means for a selecting a fabric type and for supplying an input signal to the control means (16).

8. An electric steam iron as claimed in claim 4, wherein a plurality of look-up tables or look up table sections selectable by the user have been provided.

9. An electric steam iron comprising:

at least one electrically heated soleplate (2), said soleplate (2) including at least one steam vent (20);

at least one controllable steam generator (6) for supplying steam to the at least one steam vent (20);

at least one temperature sensor means (24) for sensing the temperature of the soleplate (2) and supplying a temperature dependent signal to the control means (16);

at least one control means (16) for activating the steam generator (6) in accordance with a predetermined steam pattern, the pattern comprising:

at least a first phase of a first predetermined duration, in which steam is supplied at a substantially constant peak steam rate; and at least a second phase, in which steam is supplied at a substantially constant lower steam rate, wherein at least said peak steam rate depends upon the temperature of the sole plate (2).

10. The iron of claim 9, wherein the lower steam rate depends upon the temperature of the soleplate (2).

11. The iron of claim 10, wherein the lower steam rate is substantially equal to the steam rate that can be sustained by the electric power available for heating the soleplate (2).

12. The iron of claim 9, further comprising:

at least one steam on/off-switch (26) for supplying an input signal to the control means;

at least one hand-presence sensor (28) for supplying an input signal to the control means (16); and at least one setting means (26) for selecting a fabric type and for supplying an input signal to the control means (16); and wherein the control means (16) include a programmable microcomputer for using at least one look-up table in order to select a steam pattern depending upon the temperature dependent signal from the temperature sensor (24).

* * * * *